US006118227A

United States Patent [19]

Beland

[11] Patent Number: 6,118,227

[45] Date of Patent: Sep. 12, 2000

[54] HIGH FREQUENCY ELECTRONIC DRIVE CIRCUITS FOR FLUORESCENT LAMPS

[75] Inventor: Robert Beland, St. Marthe sur le Lac, Canada

[73] Assignee: Transfotec International LTEE, Saint-Eustache, Canada

[21] Appl. No.: 09/086,942

[22] Filed: May 29, 1998

[51] Int. Cl.[7] ..... H05B 41/16

[52] U.S. Cl. ..... 315/276; 315/144; 315/DIG. 2; 315/DIG. 5

[58] Field of Search ..... 315/141, 144, 315/147, 177, 276, 278, 282, DIG. 2, DIG. 5, DIG. 4

[56] References Cited

U.S. PATENT DOCUMENTS

| | | | |
|---|---|---|---|
| 4,149,113 | 4/1979 | Sammis | 315/219 |
| 4,277,726 | 7/1981 | Burke | 315/98 |
| 4,286,193 | 8/1981 | King, Jr. et al. | 315/175 |
| 4,370,600 | 1/1983 | Zansky | 315/244 |
| 4,392,087 | 7/1983 | Zansky | 315/278 |
| 4,467,248 | 8/1984 | Watanabe et al. | 315/241 |
| 5,004,955 | 4/1991 | Nilssen | 315/119 |
| 5,030,887 | 7/1991 | Guisinger | 315/DIG. 4 |
| 5,387,845 | 2/1995 | Nilssen | 315/209 |
| 5,448,443 | 9/1995 | Muelleman | 361/111 |
| 5,465,010 | 11/1995 | Rimmer | 307/9.1 |
| 5,530,321 | 6/1996 | Sears | 315/283 |

*Primary Examiner*—Don Wong
*Assistant Examiner*—Thuy Vinh Tran
*Attorney, Agent, or Firm*—Wolf, Greenfield & Sacks, P.C.

[57] ABSTRACT

A high-frequency power supply system for a plurality of fluorescent tubes includes an inverter type power supply connected to the primary side of the high-voltage transformer. The secondary side of the high-voltage transformer includes two high-voltage coils arranged to provide power to four hot cathode fluorescent tubes, wherein each of said high-voltage coils is connected to two of said hot cathode fluorescent tubes connected in parallel. The secondary side of the high-voltage transformer also includes supplemental coils arranged to heat filaments of the hot cathode fluorescent tubes. The power supply also includes at least one capacitor and at least one inductor connected to the secondary side and arranged in a manner that the secondary side provides power to a substantially resistive load.

20 Claims, 4 Drawing Sheets

HIGH FREQUENCY ELECTRONIC DRIVE CIRCUITS FOR FLUORESCENT LAMPS

The present invention relates to high frequency power supplies for fluorescent lamps.

A fluorescent lamp includes a glass tube containing inert gas and at least two electrodes located at the ends of the tube each electrode having one or two electrical contacts. The electrodes function as both cathode and anode because the applied voltage is alternating. The electrodes usually include oxide filaments that provide easily obtainable free electron gas. The glass tube has a phosphorous coating on its inner surface for generating visible light and contains mercury vapor mixed with an inert gas forming a Penning mixture.

Fluorescent lamps emit light by arc discharge. Initially, after starting the arc discharge, the gas column exhibits a negative resistance, that is, exhibits an increase in current across the tube and a decrease in voltage. Therefore, it is essential to use a current limiting device in series with the gas column; such device is called a ballast. There are three types of fluorescent lamps. The first type is the "instant start" fluorescent lamp, which receives, at the time of the start, a voltage sufficiently high to cause field effect emission from the cathode surface. This process provides electron carriers to initiate the arc discharge. After ignition, the electron emission is achieved by thermionic electron emission from the cathode surface caused by the lamp's arc heating of the electrodes. The power supply system of the "instant start" lamp cannot have a dimming device since a reduction in the electric arc would cause insufficient heating of the cathodes to maintain the thermionic emission.

The second commonly used type of a fluorescent lamp is the "pre-heat"(or sometimes called "switch start") fluorescent lamp. The "pre-heat" fluorescent tube has each electrode fluorescent connected to two pins. Initially, the current flows across each electrode filament from one pin to the other causing thermionic electron emission prior to the arc ignition. The heated electrodes emit an electron cloud that conducts current through the ionized gas inside the glass tube. After the lamp is ignited, the external heating is terminated and the electronic emission is sustained by the heat created by the electric arc. Similarly, as for the instant start fluorescent lamps, the pre-heat lamps can not effectively use a dimming device.

The third type is the "rapid start" fluorescent lamp. The "rapid start" fluorescent tube has each electrode filament connected to two pins. The electrode filaments are heated by an external source to a sufficient degree prior to the application of the voltage across the fluorescent tube. The external heating is continued after starting the electric arc. The "rapid start" fluorescent lamps have a longer lamp life than the other two types of fluorescent lamps.

All fluorescent lamps use either magnetic or electronic ballasts. The ballasts provide the starting and operating voltage to the tube and also limit the current level during operation. The ballasts not only limit the current across the gas column, but also have additional functions. The ballasts provide sufficient open circuit secondary voltage to initiate the electric arc, regulates the lamp current relative to the line voltage changes, and relight the lamps on each half cycle of the applied AC voltage. The ballasts also minimize the power loss and permit cathode and provide for cathode heating for "pre-heat" and "rapid start" lamps. The modern ballasts usually have a high power factor.

A standard ballast magnetic operating at 60 Hz includes a wire coil wrapped around a laminated iron core. An energy efficient magnetic ballast has copper wires instead of aluminum wires and has a larger iron core. The use of copper wires and the larger iron core reduces the heat inside the ballast. An electronic ballast operates similarly, but at a much higher frequency. The electronic solid state ballast receives a 60 Hz line voltage and converts it to a 20 to 50 KHz voltage that is transformed up to several hundred volts. The higher frequency produces less heat and results in more efficient transfer of the line power to the fluorescent lamp. Specifically, the electronic ballasts rectify the 60 Hz line voltage to a pulsating DC voltage and then converts it back to AC voltage at a higher frequency usually between 20 to 50 KHz. The electronic ballasts operate at a frequency above the natural oscillation frequency of the arc's plasma-anode fall boundary and above the frequency band of voice band telephony or the human hearing range to avoid any acoustic or telephone interference.

In general, the present invention is a high-frequency power supply system and a method for supplying a high-frequency power to several fluorescent lamps. In one aspect, a high frequency power supply system for a plurality of fluorescent tubes includes a high-voltage transformer including a primary side and a secondary side, and an inverter type power supply connected to the primary side of the high-voltage transformer. The secondary side of the high-voltage transformer is arranged to provide power to a first fluorescent tube and a second fluorescent tube having their filaments connected in parallel to the secondary side. Connected to the secondary side of the high-voltage transformer are a capacitor and an inductor both arranged in a manner that the secondary side provides power to a substantially resistive load.

A method for supplying high frequency power to a plurality of fluorescent tubes includes supplying electrical power to an inverter type power supply connected to a primary side of a high-voltage transformer; and supplying from a high-voltage secondary side of the high-voltage transformer high-frequency high-voltage power to at least two fluorescent tubes connected in parallel to the secondary side, wherein the high-voltage secondary side is subjected to a substantially resistive load.

In another aspect, a high frequency power supply system for a plurality of fluorescent tubes includes a high-voltage transformer including a primary side and a secondary side, and an inverter type power supply connected to the primary side of the high-voltage transformer. The secondary side of the high-voltage transformer is arranged to provide power to a first hot cathode fluorescent tube and a second hot cathode fluorescent tube having their filaments connected in parallel. The power supply system also includes heating elements constructed and arranged to heat filaments of the hot cathode fluorescent tubes, and at least one capacitor and at least one inductor connected to the secondary side of the high-voltage transformer and arranged in a manner that the secondary side provides power to a substantially resistive load.

This aspect may include one or more of the following features:

The capacitor may be connected in series with the first fluorescent tube and the inductor may connected in series with the second fluorescent tube. The heating elements may include supplemental coils arranged as secondary side coils of the high-voltage transformer. The supplemental coils may include a first coil connected to a first electrode of the first hot cathode fluorescent tube, a second coil connected in parallel to a second electrode of the first hot cathode fluorescent tube and a first electrode of the second hot cathode fluorescent tube, and a third coil connected to a second electrode of the second hot cathode fluorescent.

The inverter type power supply may be a push-pull resonant inverter or a square wave quasi-resonant inverter. The power supply system may further include a capacitor connected in parallel to the primary side of the high-voltage transformer.

In another aspect, a high frequency power supply system for a plurality of fluorescent tubes includes a high-voltage transformer including a primary side and a secondary side, and an inverter type power supply connected to the primary side of the high-voltage transformer. The secondary side of the high-voltage transformer including two high-voltage coils arranged to provide power to four hot cathode fluorescent tubes, wherein each of the high-voltage coils is connected to two of the hot cathode fluorescent tubes connected in parallel. The power supply system also includes heating elements constructed and arranged to heat filaments of the hot cathode fluorescent tubes, and at least one capacitor and at least one inductor connected to the secondary side and arranged in a manner that the secondary side provides power to a substantially resistive load.

This aspect may include one or more of the following features:

The heating elements may include supplemental coils arranged as secondary side coils of the high-voltage transformer. The power supply system may include two capacitors and two inductors, wherein the first capacitor is connected in series with the first fluorescent tube, the first inductor is connected in series with the second fluorescent tube, the second capacitor is connected in series with the third fluorescent tube, and the second inductor is connected in series with the fourth fluorescent tube.

In another aspect, a high-frequency electronic ballast for supplying power and controlling four hot cathode fluorescent tubes used for illuminating a commercial sign. The electronic ballast includes a high-voltage transformer including a primary side and a secondary side, a push-pull resonant inverter connected to the primary side of the high-voltage transformer, and two step-up coils forming the secondary side of the high-voltage transformer. Each step-up coil is connected to provide power in parallel to two of the fluorescent tubes. The electronic ballast also includes capacitive and inductive elements connected to the fluorescent tubes and the two step-up coils. The capacitive and inductive elements together with the fluorescent tubes are connected to form a resistive load for the two step-up coils. The electronic ballast utilizes wire connections identical to connections used by a magnetic ballast connected to four hot cathode fluorescent tubes used for illuminating the commercial sign.

The electronic ballast may further include five supplemental coils arranged as secondary side coils of the high-voltage transformer and connected to provide power for heating electrodes of the four hot cathode fluorescent tubes.

Advantageously, the novel high-frequency power supply system enables energy efficient operation of fluorescent lamps. The high-frequency power supply system can be used with standard fixtures having standard connections connecting several fluorescent lamps. The power supply system satisfies the applicable safety regulations when used in the standard fixtures. Furthermore, one defective fluorescent tube in the fixture will not cut power to the other tubes like in the prior art arrangements.

For better understanding of the present invention, reference is made to the accompanying drawings.

Figure 1:
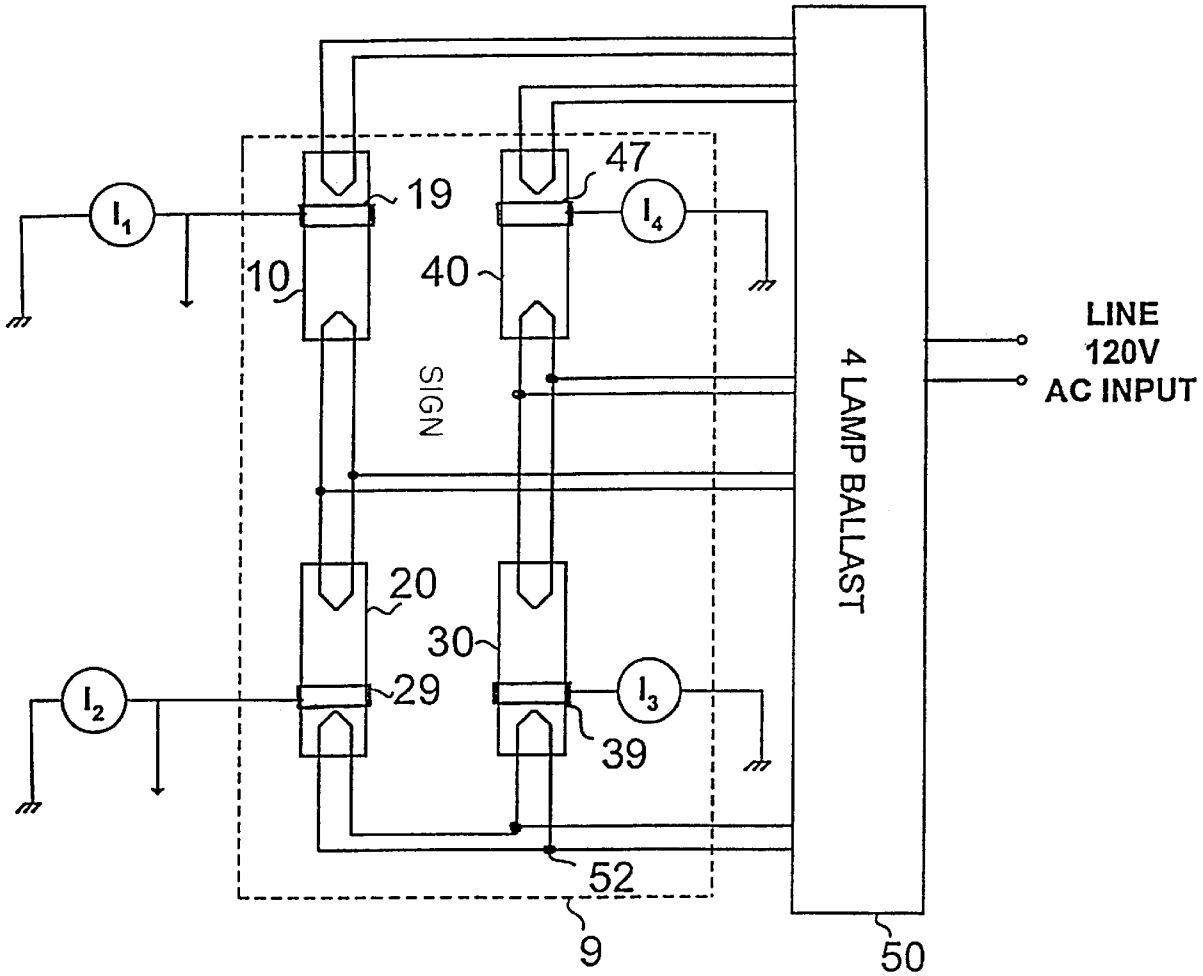
FIG. 1 shows four fluorescent tubes used for illuminating a sign and connected to a common magnetic ballast.

The sign industry uses fluorescent tubes for back lighting of display signs. Usually, several hot cathode fluorescent tubes, for example four tubes shown in FIG. 1, are connected to a single ballast. The tubes have a length of 10 feet and are usually connected in series in a standard way. Referring to FIG. 1, fluorescent lamp assembly 8 includes fluorescent tubes 10, 20, 30, and 40 located behind a commercial sign 9 and connected to a magnetic ballast 50 operating at 60 Hz (for example, MagneTek #258-496-100 or Universal #71-745-JR). The fluorescent tubes are 8 feet long, T12 type 800 mA tubes 96T12H0. Also referring to FIG. 2, magnetic ballast 50 includes auto-transformer $T_1$, capacitors $C_1$ and $C_2$, and supplemental coils 16, 22, 34, 38 and 46 used for filament heating and arranged as secondary coils of transformer $T_1$. The primary side of transformer $T_1$ is connected to the standard AC line voltage. In a standard fixture, an electrode filament 14 of fluorescent tube 10 is connected to coil 16 of transformer $T_1$. Furthermore, an electrode filament 18 of fluorescent tube 10 is connected to coil 22 of transformer $T_1$, which also provides power in parallel to an electrode filament 24 of fluorescent tube 20. The second electrode filament 26 of fluorescent tube 20 is connected in series to electrode 32 of fluorescent tube 30. Both electrodes 26 and 32 are heated by coil 34 of transformer $T_1$ connected in parallel. An electrode filament 36 of fluorescent tube 30 is connected in series to an electrode filament 42 of fluorescent tube 40. Again, both electrode filaments 36 and 42 are heated by coil 38 of transformer $T_1$ connected in parallel. An electrode filament 44 of fluorescent tube 40 is heated by a current flowing from a secondary coil 46 of transformer $T_1$.

Auto-transformer $T_1$ receives an AC line voltage of 110 V (or 220 V) and provides 800 V across tubes 10 and 20 connected in series and tubes 30 and 40 also connected in series. Capacitors $C_1$ and $C_2$ are connected to electrode filament 14 via a node 56 and electrode filament 44 via a node 58, respectively. As described above, tube 10 has electrode filament 18 connected to electrode filament 24 of tube 20, and tube 40 has electrode 42 connected to electrode 36 of tube 30. Tubes 20 and 30 have their electrodes 26 and 32 connected to a node 52, which is at 0 V. Auto-transformer $T_1$ supplies the striking voltage to the fluorescent tubes and limits the current in the tubes once the gas is ionized. After ignition, autotransformer $T_1$ provides a current of about 800 mA to the fluorescent tubes. This current is limited by the reactance of capacitors $C_1$ and $C_2$ at 60 Hz. Thus, autotransformer $T_1$ is connected to a capacitive load.

Referring again to FIG. 1, safety regulations (UL 935) set a maximum leakage current in order to reduce the risk of electric shock to a person removing the fluorescent tube while the power is turned ON. The safety test measures the leakage current to ground using a 2" wide conductive foil wrapped tightly around the fluorescent tube at any location on its surface. Specifically, conductive foils 19, 29, 39, and 47 are wrapped around tubes 10, 20, 30, and 40 and are connected to the ground to measure leakage currents $l_1$, $l_2$, $l_3$ and $l_4$, respectively. Leakage currents $l_2$ and $l_3$ are negligible since foils 29 and 39 are positioned close to filaments 26 and 32, which are connected to node 52 of the 0 V line (shown in FIG. 2). On the other hand, leakage current $l_1$ and $l_4$ measured on foils 19 and 47, respectively, have maximum values since these foils are positioned near filaments 14 and 44, connected to node 54 being at 800 V provided by auto-transformer $T_1$.

A current through a stray capacitance is proportional to the voltage, the frequency across the stray capacitance and the capacitance value. Thus, the measured leakage currents are directly proportional to the voltage applied across nodes 52 and 54, the ballast frequency, and the capacitance of the 2" foils relative to the tube. Therefore, replacing magnetic ballast 50, operating at 50 Hz, with a more efficient electronic ballast, operating above 10 kHz, would increase the leakage currents above the allowed level and thus violate the safety regulation UL935.

Figure 3:
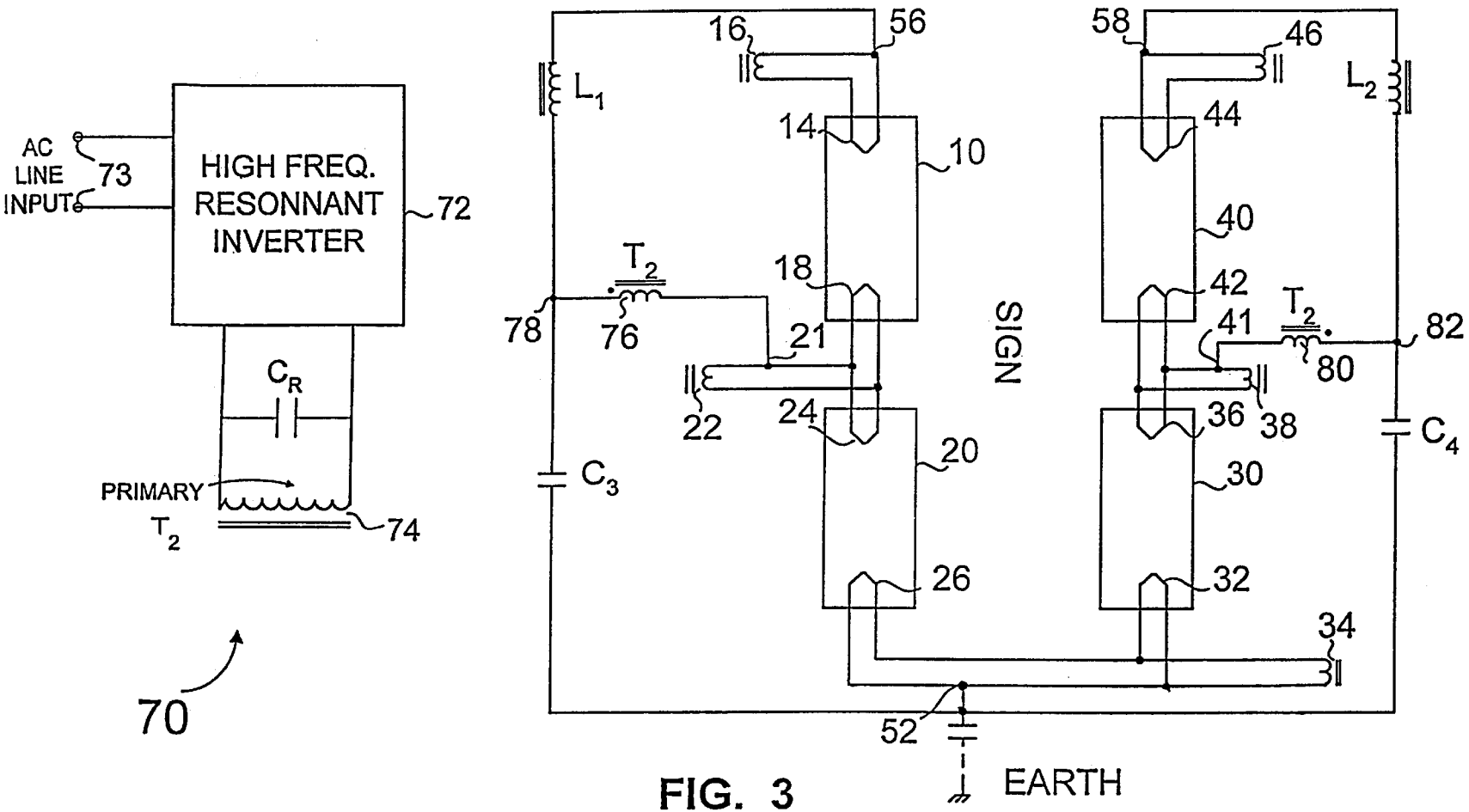
FIG. 3 shows four fluorescent tubes connected to a high frequency power supply system.

Referring to FIG. 3, according to a preferred embodiment, a high frequency power supply system 70 includes a high frequency resonant inverter 72 connected to a primary 74 of a step up transformer $T_2$. Inverter 72 receives the AC line voltage at inputs 73 and provides high frequency, high voltage power to transformer $T_2$ including primary coil 74 and two secondary coils 76 and 80. The first secondary coil 76 is connected to coil 22 at a node 21 and is also connected to a node 78. The second secondary coil 80 is connected to a node 41 and is also connected to a node 82. Node 78 is, in turn, connected to current limiting inductor $L_1$ and capacitor $C_3$ and node 82 is connected to current limiting inductor $L_2$ and capacitor $C_4$. Inductors $L_1$ and $L_2$ are, in turn, connected to nodes 56 and 58, respectively. Capacitors $C_3$ and $C_4$ are connected to node 52. In this arrangement, transformer $T_2$ supplies high frequency voltage from secondary coil 76 to fluorescent tubes 12 and 20, and supplies high frequency voltage from secondary coil 80 to fluorescent tubes 30 and 40.

Figure 2:
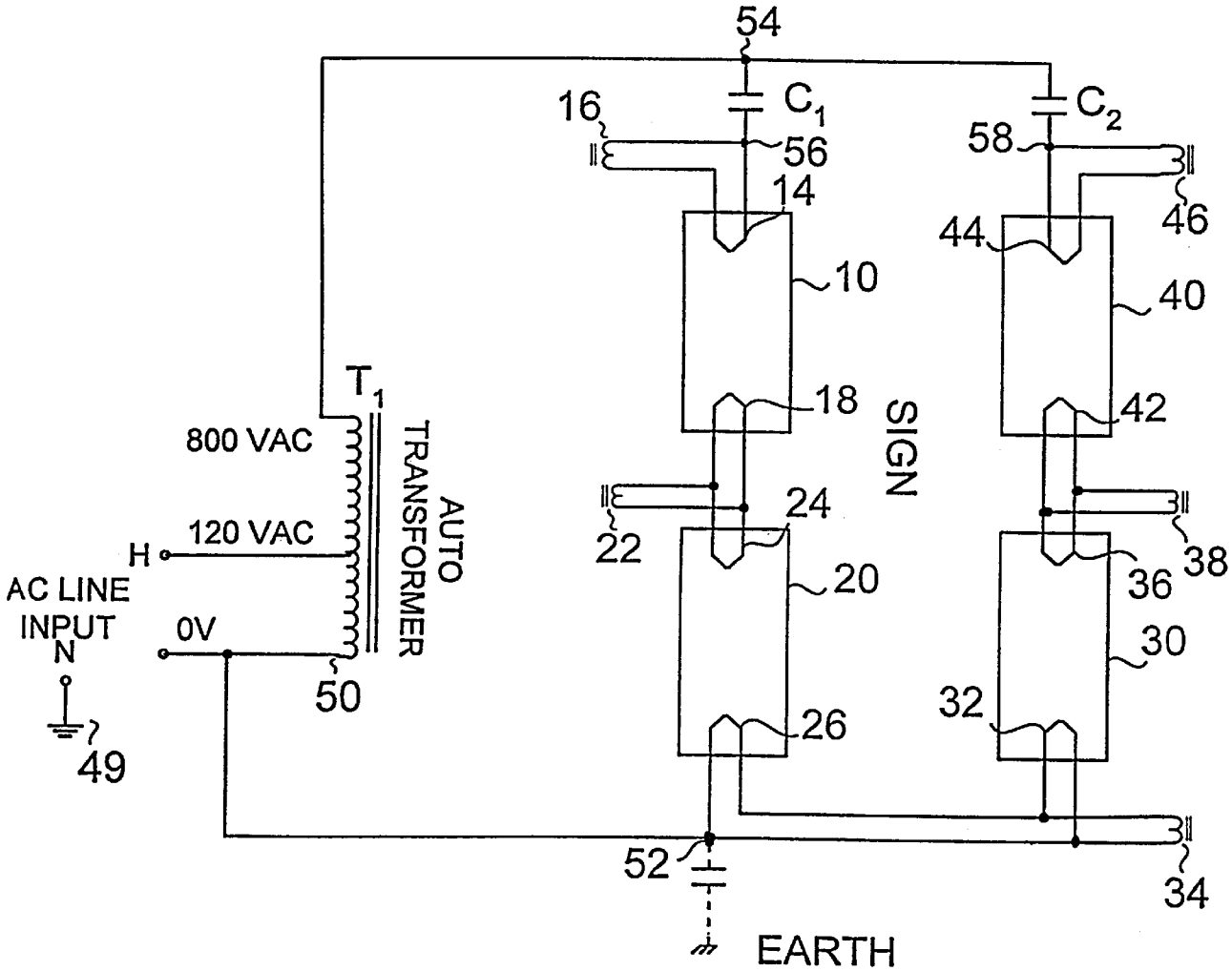
FIG. 2 shows the circuitry of a magnetic ballast connected to the fluorescent tubes shown in FIG. 1.

In this novel arrangement, fluorescent tubes 10, 20, 30 and 40 are still connected to the standard connections between nodes 52, 56 and 58, described in FIG. 2. Furthermore, supplemental coils 16, 22, 34, 38 and 46 are again arranged as secondary coils for filament heating. Current limiting inductors $L_1$ and $L_2$ are 3.4 mH, and current limiting capacitors $C_3$ and $C_4$ are 8.2 nF. Transformer $T_2$ provides high frequency voltage to the tubes and provides voltage to the heating filaments. Inverter 72 is a current fed push-pull resonant inverter, which self oscillates at the resonant frequency set by capacitor CR and the primary coil of transformer $T_2$.

Figure 4:
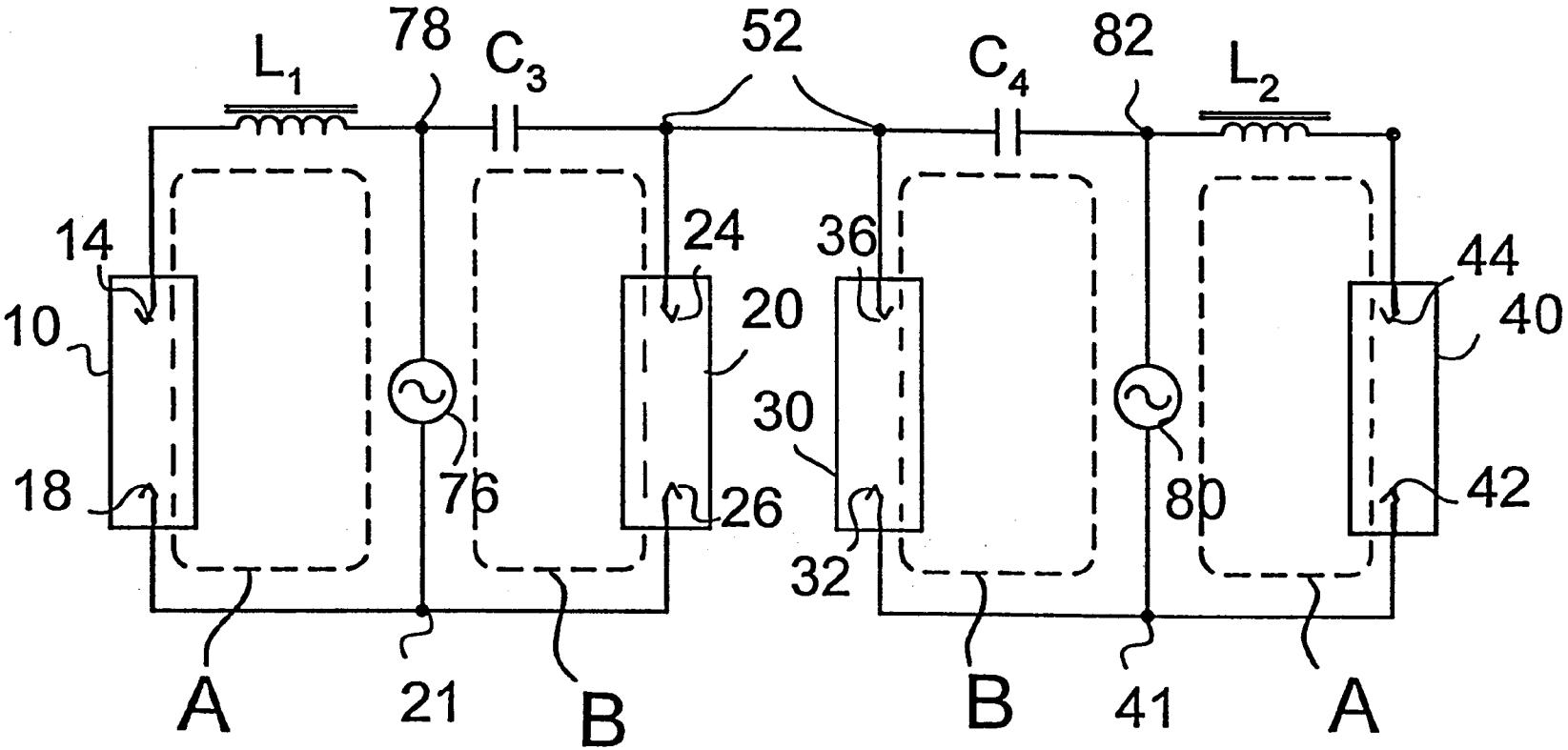
FIG. 4 shows parallel connections to the four fluorescent tubes using the power supply system shown in FIG. 3.

As shown in FIG. 4, power supply 70 provides the starting voltage to a parallel arrangement of the fluorescent tubes. Fluorescent tube 12 is connected to secondary coil 76 through current limiting inductor $L_1$. Fluorescent tube 20 is connected to secondary coil 76 through current limiting capacitor $C_3$. Thus, secondary coil 76 connected to tube 10 through inductor $L_1$ and connected to tube 20 through capacitor $C_1$ "sees" a resistive load because inverter 72 has an inductor and a capacitor connected in parallel. This design affords improved economy of operation because the phase angle of the LC circuit can be close to zero. This arrangement also assures that the resonant frequency of the inverter set by $C_R$ and the inductance of primary coil 74 will not change from no load, before striking the arc, to full load. Specifically, before striking the arc, $L_1$, $L_2$, $C_3$, $C_4$ connected to transformer $T_2$ do not pass any current and therefore do not appear as a load to transformer $T_2$. After tubes 10, 20, 30 and 40 are ignited the same current flows through $L_1$, $L_2$, $C_3$, $C_4$ and each fluorescing tube because L, current lags by the same current than leads $C_1$. The frequency is not altered after the lamps are ignited since $L_1/C_3$ and $L_2$ $C_4$ have the same reactance at the inverter resonant frequency, and therefore the power factor is unity.

Secondary coils 76 and 80 deliver voltage that is about three times less than the voltage required in the arrangement of FIG. 1. Specifically, secondary coils 76 and 80 provide only about 400 V AC to the fluorescent tubes, as if the tubes were connected in parallel. Thus the leakage current is below the maximum allowed by the safety standard UL 935.

A method for providing high frequency power to four fluorescent tubes includes connecting a high frequency inverter 72 to a primary coil 74 of high voltage transformer $T_2$. Secondary coil 76 and 80 supply power to two fluorescent tubes connected in parallel. As shown in FIG. 4, coil 76 provides AC current to node 21 and to node 78. From node 21, the applied current (shown as a line A) flows across tube 10 and current limiting inductor $L_1$ to node 78. Furthermore, the provided current (shown as a line B) flows across tube 20 through current limiting capacitor $C_3$. Secondary coil 80 provides the applied current (shown as a line B) to node 41 across tube 30 and capacitor $C_4$ to node 82. Furthermore, the current flows from node 41 across tube 40 and current limiting inductor $L_2$ to node 82. Secondary high voltage coils 76 and 82 provide about 400 V AC, which is about one half of the standard voltage of 800 V used by magnetic ballast 50 (FIG. 2). This voltage is sufficient to strike the fluorescent tubes due to their parallel connection. The method also includes providing to high frequency inverter 72 a substantially resistive load constituted by the current limiting inductors and capacitors and, therefore, not altering the resonant frequency set by the inverter resonant circuit formed by primary coil 74 connected in parallel to capacitor $C_R$.

The employed inverter is a current fed, push-pull resonant inverter that is self oscillating at the frequency determined by CR and the primary side of transformer $T_2$. Alternatively, a square wave quasi-resonant inverter may be used.

Additional embodiments are within the following claims:

1. A high frequency power supply system for a plurality of fluorescent tubes comprising:

a high-voltage transformer including a primary side and a secondary side;

an inverter type power supply connected to said primary side of said high-voltage transformer;

said secondary side of said high-voltage transformer arranged to provide power to a first hot cathode fluorescent tube and a second hot cathode fluorescent tube having their filaments connected in parallel, said first hot cathode fluorescent tube and said second hot cathode fluorescent tube being connected in parallel to said secondary side of said high-voltage transformer;

heating elements constructed and arranged to heat filaments of said hot cathode fluorescent tubes; and at least one capacitor and at least one inductor connected to said secondary side of said high-voltage transformer and arranged in a manner that said secondary side provides power to a substantially resistive load.

2. The power supply system of claim 1 wherein said capacitor is connected in series with said first fluorescent tube and said inductor is connected in series with said second fluorescent tube thus said secondary side of said high-voltage transformer being connected in parallel with said serially connected capacitor and first fluorescent tube and said serially connected inductor and second fluorescent tube.

3. The power supply system of claim 1 wherein said heating elements include supplemental coils arranged as secondary side coils of said high-voltage transformer.

4. The power supply system of claim 3 wherein said supplemental coils include a first coil connected to a first electrode of said first hot cathode fluorescent tube, a second coil connected in parallel to a second electrode of said first hot cathode fluorescent tube and a first electrode of said second hot cathode fluorescent tube, and a third coil connected to a second electrode of said second hot cathode fluorescent.

5. The power supply system of claim 1 wherein said inverter type power supply includes a push-pull resonant inverter.

6. The power supply system of claim 5 further includes a capacitor connected in parallel to said primary side of said high-voltage transformer.

7. A high frequency power supply system for a plurality of fluorescent tubes comprising:

a high-voltage transformer including a primary side and a secondary side;

an inverter type power supply connected to said primary side of said high-voltage transformer;

said secondary side of said high-voltage transformer including two high-voltage coils arranged to provide power to four hot cathode fluorescent tubes wherein each of said high-voltage coils is connected to two of said hot cathode fluorescent tubes connected in parallel;

heating elements constructed and arranged to heat filaments of said hot cathode fluorescent tubes; and at least one capacitor and at least one inductor connected to said secondary side and arranged in a manner that said secondary side provides power to a substantially resistive load.

8. The power supply system of claim 7 wherein said heating elements include supplemental coils arranged as secondary side coils of said high-voltage transformer.

9. The power supply system of claim 7 including two capacitors and two inductors, wherein a first of said capacitors is connected in series with a first of said fluorescent tubes, a first of said inductors is connected in series with a second of said fluorescent tubes, a second of said capacitors is connected in series with a third of said fluorescent tubes and a second of said inductors is connected in series with a fourth of said fluorescent tubes.

10. The power supply system of claim 7 wherein said inverter type power supply and said high-voltage transformer are arranged for said secondary side to provide a voltage of less than 800 V AC.

11. The power supply system of claim 7 wherein said inverter type power supply and said high-voltage transformer are arranged for said secondary side to provide a voltage of about 400 V AC.

12. The power supply system of claim 7 wherein said hot cathode fluorescent tubes are arranged to illuminate a commercial sign.

13. A high frequency power supply system for a plurality of fluorescent tubes comprising:

high-voltage transformer means including a primary side means and a secondary side means;

power supply means connected to said primary side means;

said secondary side means being arranged to provide power in parallel to both a first fluorescent tube and a second fluorescent tube; and capacitor and inductor elements forming together with said fluorescent tubes resistive load means connected to said secondary side means.

14. The power supply system of claim 13 wherein said secondary side means is further arranged to provide power in parallel to a third fluorescent tube and a fourth fluorescent tube.

15. A high-frequency electronic ballast for supplying power and controlling four hot cathode fluorescent tubes used for illuminating a commercial sign, said electronic ballast comprising a high-voltage transformer including a primary side and a secondary side;

a push-pull resonant inverter connected to said primary side of said high-voltage transformer;

two step-up coils forming said secondary side of said high-voltage transformer, each said step-up coil being connected to provide power in parallel to two of said fluorescent tubes; and capacitive and inductive elements connected to said fluorescent tubes and said two step-up coils, said capacitive and inductive elements together with said fluorescent tubes being connected to form a resistive load for said two step-up coils, wherein said electronic ballast utilizing wire connections identical to connections used by a magnetic ballast connected to four hot cathode fluorescent tubes used for illuminating said commercial sign.

16. The electronic ballast of claim 15 further including five supplemental coils arranged as secondary side coils of said high-voltage transformer and connected to provide power for heating electrodes of said four hot cathode fluorescent tubes.

17. A method of supplying high-frequency, high-voltage power to a plurality of hot cathode fluorescent tubes comprising the acts of:

supplying electrical power to an inverter type power supply connected to provide high-frequency signal to a primary side of a high-voltage transformer;

supplying from a high-voltage secondary side of said high-voltage transformer high-frequency high-voltage power to at least two hot cathode fluorescent tubes connected in parallel to said secondary side, a first of said fluorescent tubes having a capacitor connected in series and a second of said fluorescent tubes having an inductor connected in series, said high-voltage secondary side providing said high-voltage power in parallel to said serially connected capacitor and first fluorescent tube and said serially connected inductor and second fluorescent tube thereby forming a substantially resistive load to said high-voltage secondary side.

18. The method of claims 17 wherein said providing high-frequency signal by said inverter type power supply includes providing a capacitor in parallel with said primary side to operate at a resonant frequency.

19. The method of claims 17 wherein said supplying power from a high-voltage secondary side includes heating filaments of said hot cathode fluorescent tubes.

20. The method of claims 17 wherein said supplying power from a high-voltage secondary side includes providing said capacitor having a capacitance value and said inductor having an inductance value causing current lag substantially the same as current lead caused by said capacitance.

* * * * *